US006932444B2

(12) United States Patent
Price

(10) Patent No.: US 6,932,444 B2
(45) Date of Patent: Aug. 23, 2005

(54) LOCKING DRAWER

(76) Inventor: Delbert E. Price, 1987 Warren Dr., Fort Mitchell, KY (US) 41017

( * ) Notice: Subject to any disclaimer, the term of this patent is extended or adjusted under 35 U.S.C. 154(b) by 261 days.

(21) Appl. No.: 10/341,050

(22) Filed: Jan. 13, 2003

(65) Prior Publication Data

US 2004/0135477 A1 Jul. 15, 2004

(51) Int. Cl.[7] ..... E05B 65/46
(52) U.S. Cl. ..... 312/219; 312/215; 312/333
(58) Field of Search ..... 312/215, 219, 312/330.1, 333

(56) References Cited

U.S. PATENT DOCUMENTS

| | | | | |
|---|---|---|---|---|
| 527,043 | A | | 10/1894 | Beck |
| 683,835 | A | | 10/1901 | Beckwith |
| 1,700,299 | A | * | 1/1929 | Wolters ..... 312/333 |
| 2,582,654 | A | | 1/1952 | Saban |
| 2,835,547 | A | | 5/1958 | Erismann |
| 3,622,216 | A | | 11/1971 | Haunost |
| 3,655,292 | A | | 4/1972 | Savage |
| 3,748,621 | A | | 7/1973 | Sakats |
| 3,752,547 | A | | 8/1973 | Propst et al. |
| 4,057,306 | A | | 11/1977 | Resch, Jr. |
| 4,246,769 | A | * | 1/1981 | McLaughlin ..... 312/219 |
| 4,629,263 | A | | 12/1986 | Hendriks |
| 4,721,347 | A | | 1/1988 | Kritselis |
| 5,069,511 | A | | 12/1991 | Swets et al. |
| 5,291,763 | A | | 3/1994 | Cuisinot |
| 5,314,244 | A | | 5/1994 | Swets et al. |
| 5,638,977 | A | | 6/1997 | Bianchi |
| 5,782,545 | A | | 7/1998 | Kahara et al. |
| 6,109,709 | A | | 8/2000 | Holcomb et al. |
| 6,347,848 | B1 | | 2/2002 | Cho |
| 6,698,258 | B2 | * | 3/2004 | Westwinkel ..... 312/219 |

OTHER PUBLICATIONS

"19MM Mul–T–Lock Cam Lock", City Wide Security Safe and Lock Superstore, http://shop.store.yahoo.com/citywidesecurity/19mmcamlock.html, 1 page.
"Products—Locks", Mul–T–Lock—Manufacturers of High Security Locking Systems, http://www.mul–t–lock.ca/indexMultlock.html, 2 pages.
"Locks", KD Locks Co., Ltd., http://www.kdlock.com/pro07.htm, 2 pages.
"High Security Products by Medeco", Fuller's Alamo Safe and Lock, Inc., http://www.alamosafeandlock.com/Medeco%20Page1.htm, 2 pages.
"Installation Notes", Olympus Lock, Inc., http:www.olympus–lock.com, Misc. 5 pages.

* cited by examiner

*Primary Examiner*—Anthony D. Barfield
(74) *Attorney, Agent, or Firm*—Steven J. Rosen

(57) ABSTRACT

A casing includes a housing has a pair of spaced apart housing side walls and housing rear wall therebetween. A drawer slidably supported within the housing has a bottom, drawer side walls extending vertically from the bottom, and drawer front and rear walls extending vertically from the bottom. A key retaining lock is disposed in the drawer front wall and a rotatable shaft is connected to the lock and extends through an interior of the drawer to the drawer rear wall. A rotatable locking cam is connected to the shaft and located behind the drawer rear wall. A blocking member attached to the housing is located to cooperate with the locking cam to lock the drawer in a closed position. A stop block attached to the housing blocks the locking cam until the locking cam is in a position to cooperate with the blocking member to lock the drawer in a closed position.

18 Claims, 4 Drawing Sheets

LOCKING DRAWER

BACKGROUND OF THE INVENTION

Field of the Invention

The present invention relates to casings used in cabinets and carts with lockable drawers such as may be used for storing pharmaceuticals and, more particularly, to casings with drawers having key retaining locks which retain the key until the key is rotated to drawer locking position.

Lockable casing drawers such as cabinet and cart drawers are widely used in hospitals and other medical care facilities to hold pharmaceuticals. Keeping pharmaceuticals secure from unauthorized access is a matter of major concern in the medical care facilities to prevent theft and misuse of the pharmaceuticals and to comply with legal requirements concerning controlled substances. Security of pharmaceutical casing drawers is particularly important in hospitals and the like. It is a general requirement in hospitals and the like that pharmaceutical cabinet and cart drawers be locked when not attended by an authorized person.

Examples of such cabinets and carts may be found in U.S. Pat. Nos. 3,752,547 and 5,069,511. U.S. Pat. No. 3,752,547 discloses a cam-type lock in a front of a drawer which includes a lock pin which locks the drawer by cooperating with a blocking flange connected to the cabinet body or frame. Alternatively, a rotatable cam on the lock could be used to engage the flange. One type of cam lock that is used has a key retaining feature and the key can only be removed when the cam is in a fully locked or rotated position cooperating with the flange and, optionally, when the cam is in a fully open position and not cooperating with the flange. A disadvantage of this locking arrangement is that the key can be turned to the locked position and removed with the pin or the cam not positioned to cooperate with the flange because the pin or cam is in front of the flange but the drawer is not in the closed or locked position.

It is therefore desirable to provide a cabinet or cart with a fool-proof lock which may be readily locked and unlocked and with which the key cannot be removed from the lock without the drawer being in the fully locked or closed position.

BRIEF DESCRIPTION OF THE INVENTION

A casing which may be used in a cart or stationary cabinet includes a housing having a pair of spaced apart first and second housing side walls and housing rear wall therebetween. A drawer slidably supported within the housing has a bottom, first and second drawer side walls extending vertically from the bottom, and drawer front and rear walls extending vertically from the bottom. A key retaining lock is disposed in the drawer front wall and a rotatable shaft is connected to the lock and extends through an interior of the drawer to the drawer rear wall. A rotatable locking cam is connected to the shaft and located behind the drawer rear wall.

An exemplary embodiment of the casing further includes a blocking member attached to the housing and is located to cooperate with the locking cam to lock the drawer in a closed position. The casing further includes a stop block attached to the housing and having a length and location which blocks the rotation of the locking cam until the locking cam is in a position to cooperate with the blocking member to lock the drawer in a closed position. The lock, the shaft, and the locking cam, are all located near one of the first and second drawer side walls and the stop block attached to a corresponding one of the housing first and second housing side walls nearest the lock. The casing further includes spaced apart first and second pairs of first and second guides supported by the first and second housing side walls, respectively. Each of the guides includes spaced apart top and bottom guide flanges.

The drawer has first and second glide flanges connected to the first and second drawer side walls, respectively. The first and second glide flanges are slidably disposed between the top and bottom guide flanges of the first and second pairs of first and second guides, respectively. The blocking member is a rear blocking flange supported by the second housing side wall and illustrated as depending downwardly from a rear end of the top guide flange located near the housing rear wall. The stop block is disposed below bottom guide flange in abutting relationship to the rear blocking flange. The casing further includes a forward flange spaced apart from the rear blocking flange, supported by the second housing side wall, and illustrated as depending downwardly from a front end of the top guide flange.

DETAILED DESCRIPTION OF THE INVENTION

Figure 1:
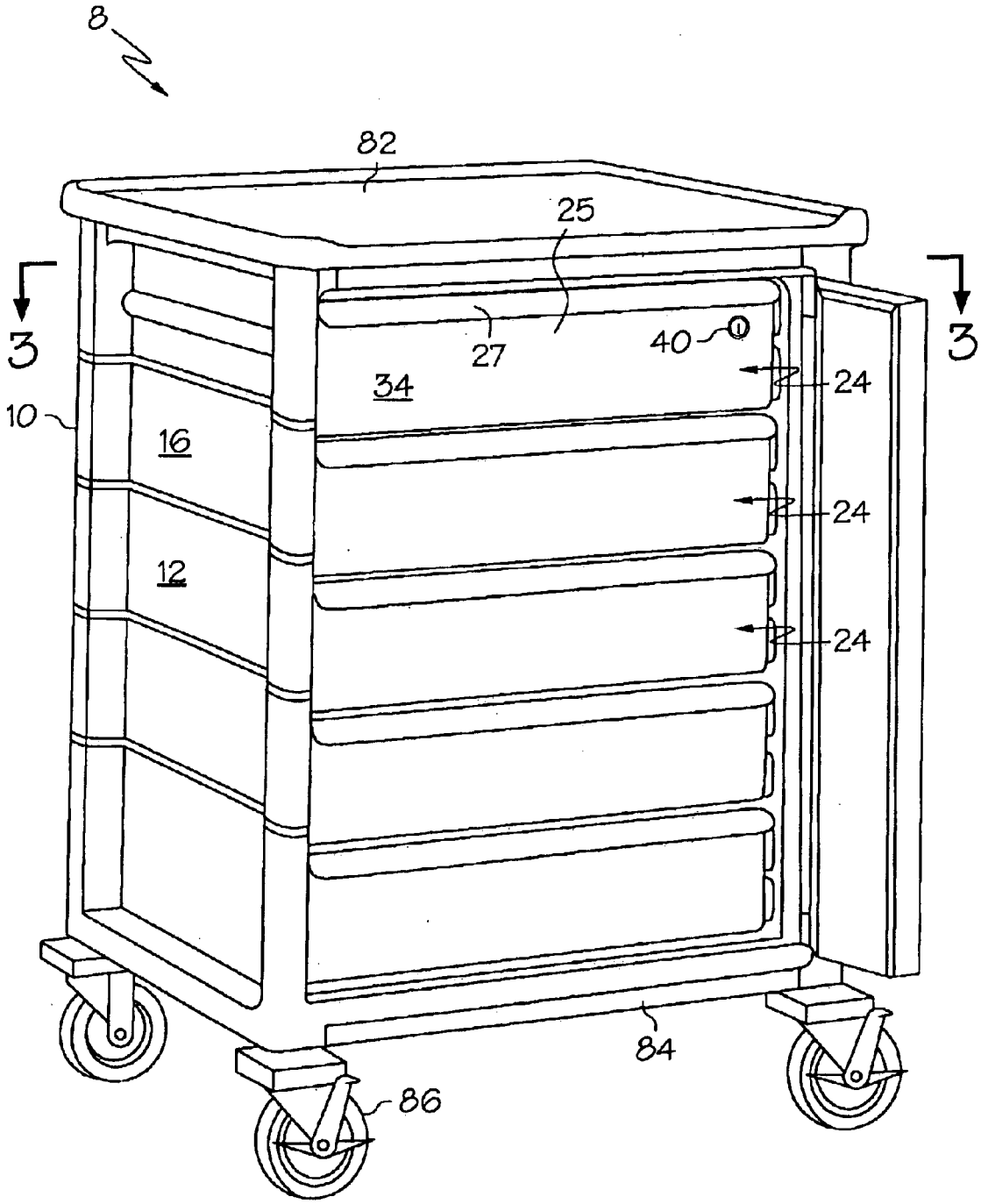
FIG. 1 is a perspective view of a pharmaceutical cart including a pull-out drawer with a lock of a fool-proof locking apparatus.
Figure 2:
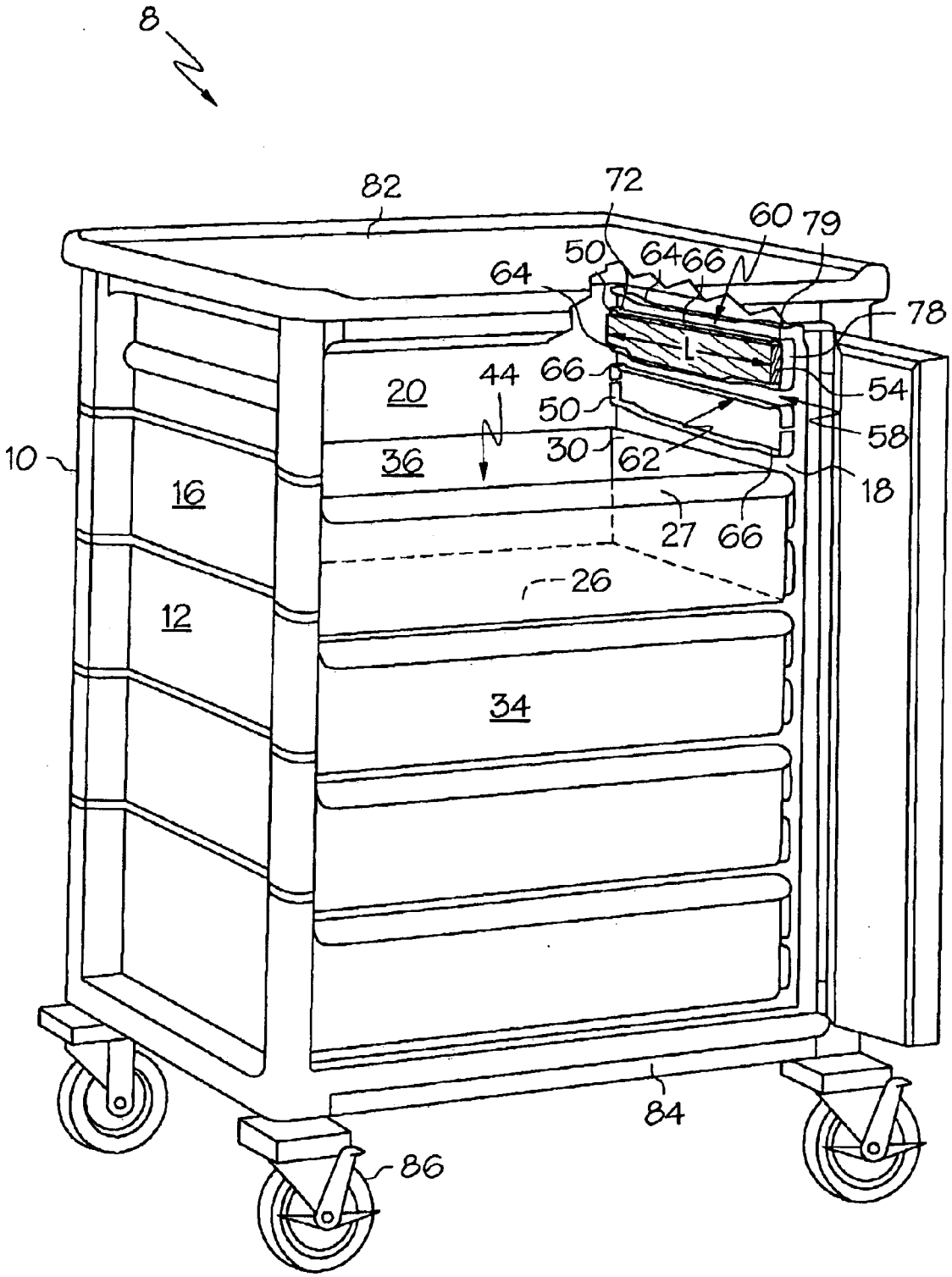
FIG. 2 is a perspective view of a block of the locking apparatus in casing of the cart illustrated in FIG. 1.

Illustrated in FIGS. 1 and 2 is an exemplary embodiment of a medical cart 8 having a casing 10 which may be used in a cart or stationary cabinet. The casing 10 includes a housing 12 having a pair of spaced apart first and second housing side walls 16 and 18 and housing rear wall 20 therebetween. Several drawers 24 are illustrated as being slidably supported within the housing 12. The top one 25 of the drawers 24 is a lockable drawer. The drawer 24 includes a handle 27.

Figure 3:
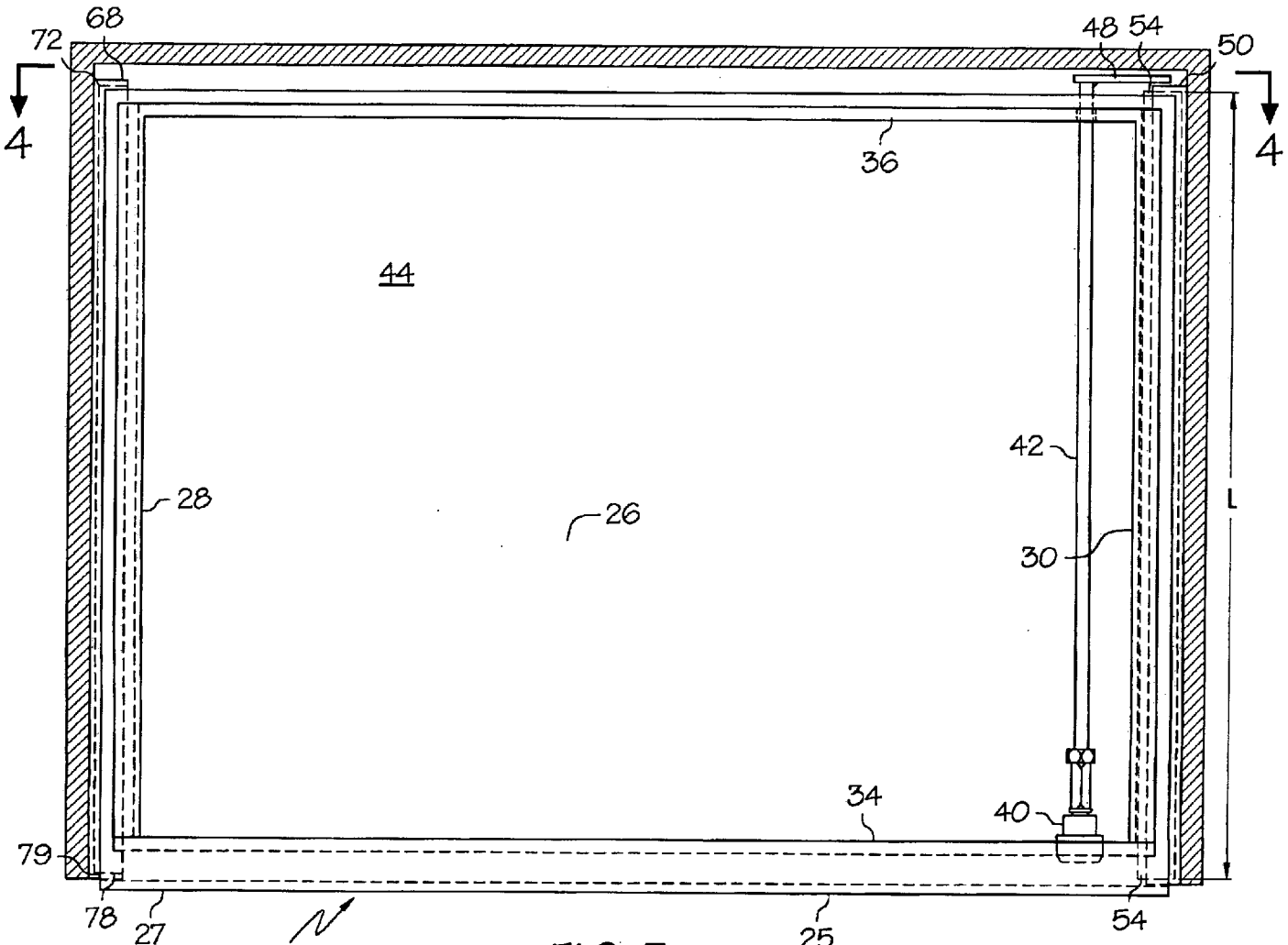
FIG. 3 is a perspective view of the locking apparatus in the drawer illustrated in FIG. 1.

Referring more specifically to FIGS. 2 and 3, the drawer 24 has a bottom 26 (outlined in phantom), first and second drawer side walls 28 and 30 extending vertically from the bottom, and drawer front and rear walls 34 and 36 extending vertically from the bottom. A key retaining lock 40 is disposed in the drawer front wall 34 and a rotatable shaft 42 is connected to the lock 40 and extends through an interior 44 of the drawer 24 to the drawer rear wall 36. A rotatable locking cam 48 is connected to the shaft 42 and located behind the drawer rear wall 36 exterior to the interior 44 of the drawer 24.

Referring to FIGS. 2 and 3, the exemplary embodiment of the casing 10 further includes a blocking member 50 attached to the housing 10 and is located to cooperate with the locking cam 48 to lock the drawer in a closed position. The casing 10 further includes a stop block 54 attached to the housing 12 and having a length L and a location which blocks the rotation of the locking cam 48 until the locking cam 48 is in a position to cooperate with the blocking member 50 to lock the drawer 24 in a closed position.

Figure 4:
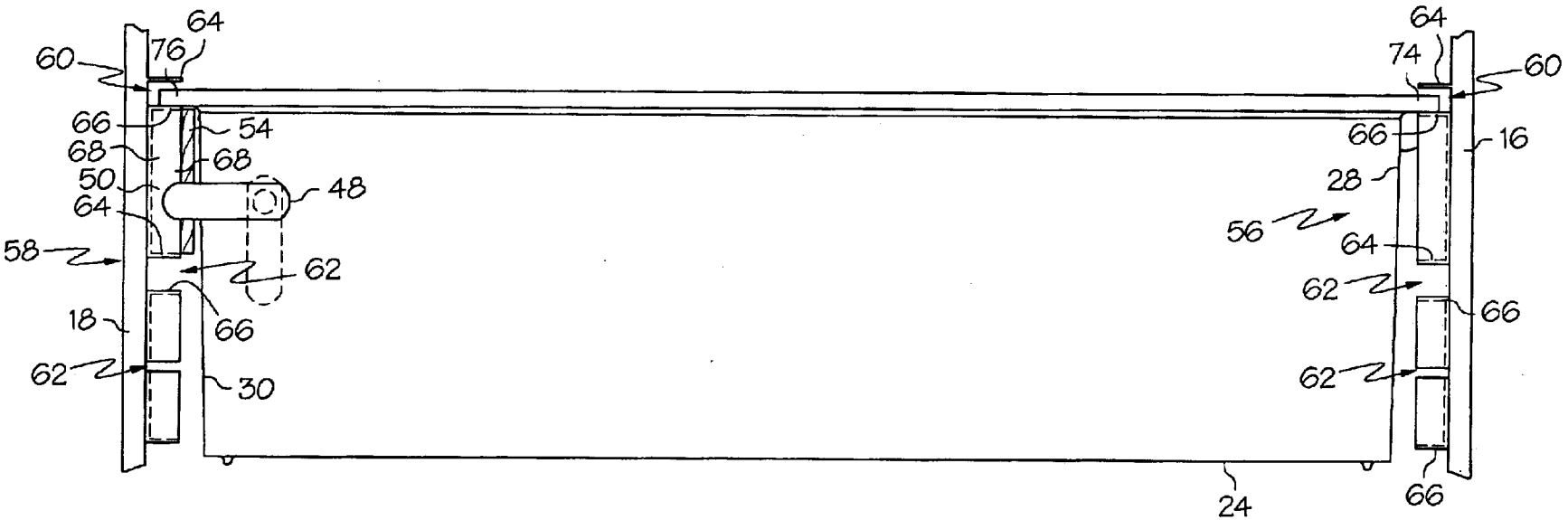
FIG. 4 is a cross-sectional view illustration of the locking apparatus in the drawer and casing of the cart illustrated in FIG. 1.

The lock 40, the shaft 42, and the locking cam 48, are all located hear one of the first and second drawer side walls 28 and 30 and the stop block 54 is attached to a corresponding one of the housing first and second housing side walls 16 and 18 nearest the lock. In the exemplary embodiment illustrated herein the lock 40, the shaft 42, and the locking cam 48, are all located near the second drawer side wall 30 and the stop block 54 is attached to the housing second housing side wall 18. Illustrated in FIGS. 2 and 4 are spaced apart first and second pairs 56 and 58 of first and second guides 60 and 62 supported by the first and second housing side walls 16 and 18, respectively. Each of the guides includes spaced apart top and bottom guide flanges 64 and 66.

The drawer 24 has first and second glide flanges 74 and 76 connected to the first and second drawer side walls 28 and 30, respectively. The first and second glide flanges 74 and 76 are slidably disposed between the top and bottom guide flanges 64 and 66 of the first and second pairs 56 and 58 of first and second guides 60 and 62, respectively. The blocking member is a rear blocking flange 68 supported by the second housing side wall 18 and illustrated as depending downwardly from a rear end 72 of the top guide flange 64 located near the housing rear wall. The stop block 54 is disposed below the bottom guide flange 66 in abutting relationship to the rear blocking flange 68. The casing 10 further includes a forward flange 78 spaced apart from the rear blocking flange 68, supported by the second housing side wall 18, and illustrated as depending downwardly from a front end 79 of the top guide flange 64. The stop block 54 is disposed below the bottom guide flange 66. In the exemplary embodiment illustrated herein, the stop block 54 is disposed between the bottom guide flange 66 that supports the top lockable drawer 24 and a lower top guide flange 64 that is directly below. The stop block 54 is in abutting relationship to the rear blocking flange 68. The stop block 54 generally conforms to the space between the forward flange 78 and the rear blocking flange 68 and between the bottom guide flange 66 that supports the top lockable drawer 24 and the lower top guide flange 64 that is directly below.

The drawer 24 is opened by inserting a key, not illustrated, into the lock 40, turning the key to an open position, and pulling the drawer open with the handle 27. The turning of the key rotates shaft 42 and the locking cam 48 from the cam's locked position in which the cam cooperates with the blocking member 50 to prevent the drawer 24 from being pulled open. In FIG. 4 the cam 48 is illustrated in a sideways locked position in solid line and in an open position in dashed line. The locking cam's open position in allows the drawer 24 to be pulled open. The key retaining lock 40 does not allow the key to be removed unless the cam is in the fully locked position and the drawer 24 is in the fully closed position which corresponds to the cam 48 cooperating with the blocking member 50 to prevent the drawer 24 from being pulled open. The stop block 54 blocks the rotation of the locking cam 48 until the locking cam 48 is in a position to cooperate with the blocking member 50 to lock the drawer 24 in the closed position.

The medical cart 8 includes a cart top 82 mounted on top of the housing 12. The housing 12 is mounted on a cart base 84 having casters 86 to give the cart mobility. Wheels or other rolling means for rolling the cart around in order to give the cart mobility maybe be substituted for the casters.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A casing comprising:

a housing having a pair of spaced apart first and second housing side walls and housing rear wall therebetween;

a drawer slidably supported within the housing and having a bottom, first and second drawer side walls extending vertically from the bottom, drawer front and rear walls extending vertically from the bottom;

a key retaining lock disposed in the drawer front wall;

a rotatable shaft connected to the lock and extending through an interior of the drawer to the drawer rear wall; and a rotatable locking cam connected to the shaft and located exterior to the drawer rear wall.

2. The casing claimed in claim 1, further comprising a blocking member attached to the housing and located to cooperate with the locking cam to lock the drawer in a closed position.

3. The casing claimed in claim 2, further comprising a stop block attached to the housing and having a length and location which blocks the rotation of the locking cam until the locking cam is in a position to cooperate with the blocking member to lock the drawer in a closed position.

4. The casing claimed in claim 3, further comprising the lock, the shaft, and the locking cam, located near one of the first and second drawer side walls and the stop block attached to a corresponding one of the housing first and second housing side walls nearest the lock.

5. The casing claimed in claim 4, further comprising:

spaced apart first and second pairs of first and second guides supported by the first and second housing side walls respectively;

each of said guides including spaced apart top and bottom guide flanges;

the drawer having first and second glide flanges connected to the first and second drawer side walls respectively;

the first and second glide flanges being slidably disposed between the top and bottom guide flanges of the first and second pairs of first and second guides respectively;

and the blocking member being a rear blocking flange depending downwardly from a rear end of the top guide flange located near the housing rear wall, and the stop block disposed below the bottom guide flanges in abutting relationship to the rear blocking flange.

6. The casing claimed in claim 5, further comprising a forward flange spaced apart from the rear blocking flange, supported by the second housing side wall, and depending downwardly from a front end of the top guide flange.

7. The casing claimed in claim 6, further comprising a forward flange spaced apart from the rear blocking flange, supported by the second housing side wall, and depending downwardly from a front end of the top guide flange and the stop block disposed within a space between the forward flange and the rear blocking flange and between the bottom guide flange that supports the top lockable drawer and a second top guide flange that is directly below the bottom guide flange.

8. The casing claimed in claim 7, wherein the stop block generally conforms to a shape of the space.

9. A cart comprising:

a housing having a pair of spaced apart first and second housing side walls and housing rear wall therebetween;

the housing mounted on a cart base having rolling means for rolling the cart;

a drawer slidably supported within the housing and having a bottom, first arid second drawer side walls extending vertically from the bottom, drawer front and rear walls extending vertically from the bottom;

a key retaining lock disposed in the drawer front wall;

a rotatable shaft connected to the lock and extending through an interior of the drawer to the drawer rear wall; and a rotatable locking cam connected to the shaft and located exterior to the drawer rear wall.

10. The cart claimed in claim 9, further comprising a blocking member attached to the housing and located to cooperate with the locking cam to lock the drawer in a closed position.

11. The cart claimed in claim 10, further comprising a stop block attached to the housing and having a length and location which blocks the rotation of the locking cam until the locking cam is in a position to cooperate with the blocking member to lock the drawer in a closed position.

12. The cart claimed in claim 11, further comprising the lock, the shaft, and the locking cam, located near one of the first and second drawer side walls and the stop block attached to a corresponding one of the housing first and second housing side walls nearest the lock.

13. The cart claimed in claim 12, further comprising:

spaced apart first and second pairs of first and second guides supported by the first and second housing side walls respectively;

each of said guides including spaced apart top and bottom guide flanges;

the drawer having first and second glide flanges connected to the first and second drawer side walls respectively;

the first and second glide flanges being slidably disposed between the top and bottom guide flanges of the first and second pairs of first and second guides respectively;

and the blocking member being a rear blocking flange depending downwardly from a rear end of the top guide flange located near the housing rear wall, and the stop block disposed below the bottom guide flanges in abutting relationship to the rear blocking flange.

14. The cart claimed in claim 13, further comprising a forward flange spaced apart from the rear blocking flange, supported by the second housing side wall, and depending downwardly from a front end of the top guide flange.

15. The cart claimed in claim 14, further comprising a forward flange spaced apart from the rear blocking flange, supported by the second housing side wall, and depending downwardly from a front end of the top guide flange and the stop block disposed within a apace between the forward flange and the rear blocking flange and between the bottom guide flange that supports the top lockable drawer and a second top guide flange that is directly below the bottom guide flange.

16. The cart claimed in claim 15, wherein the stop block generally conforms to a shape of the space.

17. The cart claimed in claim 16, wherein the rolling means are casters.

18. The cart claimed in claim 12, wherein the rolling means are casters.

* * * * *